United States Patent [19]

Michelberger

[11] 4,062,307

[45] Dec. 13, 1977

[54] BINDING MACHINE FOR MATERIALS SUCH AS CARPETS, CARPET STRIPS OR THE LIKE

[75] Inventor: Stefan Michelberger, Laudenbach, Main-Tauber-Kreis, Germany

[73] Assignee: Firma Maximilian Janser, Germany

[21] Appl. No.: 645,467

[22] Filed: Dec. 30, 1975

[30] Foreign Application Priority Data

| | | |
|---|---|---|
| Jan. 8, 1975 | Germany | 2500461 |
| Nov. 18, 1975 | Germany | 2551712 |

[51] Int. Cl.[2] ..... D05B 23/00

[52] U.S. Cl. ..... 112/7

[58] Field of Search ..... 112/7, 8, 169, 162, 112/235, 197, 198, 199, 80

[56] References Cited

U.S. PATENT DOCUMENTS

| | | | |
|---|---|---|---|
| 377,525 | 2/1888 | Lachman | 112/162 |
| 408,009 | 7/1889 | Goodwin | 112/162 |
| 2,075,656 | 3/1937 | Paternayan | 112/7 |
| 2,547,821 | 4/1951 | Hartwell | 112/7 |
| 3,433,192 | 3/1969 | Pingatore et al. | 112/235 |
| 3,726,240 | 4/1973 | Emich | 112/214 X |

*Primary Examiner*—Werner H. Schroeder
*Assistant Examiner*—Peter Nerbun
*Attorney, Agent, or Firm*—J. Rodman Steele, Jr.

[57] ABSTRACT

A portable integral compact rug binding machine which may be guided along the outside edge of a carpet to be bound by means of a handle is disclosed. The rug binding machine is provided with a vertically mounted drive motor and a low or close to the floor base member wherein a portion or zone of the carpet being bound curves up and over the base plate or support means without need for folding the carpet back over its entire length. The binding machine performs the binding operation with the use of a single binding thread fed to the needle from above. A driven carrier roll is provided for moving the carpet with respect to the binding needle, and in one embodiment, an adjustable pressure roller is provided for enabling binding around curved edges of the carpeting.

32 Claims, 13 Drawing Figures

29
32
13
56
67
68
55
60
59
66
67'

BINDING MACHINE FOR MATERIALS SUCH AS CARPETS, CARPET STRIPS OR THE LIKE

BACKGROUND OF THE INVENTION

The invention concerns a binding machine for materials such as carpets, carpet strips or the like with a machine frame carrying a drive motor, a transportation mechanism for the material to be bound, a binding mechanism with a needle guided essentially perpendicularly and a holder for the supply of binding thread as well as a supply of edging strip or binding tape if required.

Such binding machines are necessary in order to make carpets, carpet strips, etc. from floor covering materials delivered as yard goods. The binding provides not only an improved appearance of the cut edges but also prevents the edges from fraying.

A well known rug binding machine described in U.S. Pat. No. 2,547,821 is essentially constructed as a heavy sewing machine and has a very bulky base plate and a conventional projecting arm which carries the machine head. The machine is mounted on a heavy machine table which is mounted on wheels. The drive motor is located under the machine table. The known rug binding machine operates with two threads which are introduced independently from the top and from the bottom. To operate it, the heavy machine must be lifted onto the rug and the edges of the rug looped back 180° and inserted into the machine.

When the thread color is changed, if no disturbing threads of the lower thread are to be visible, the upper and lower threads must both be changed.

SUMMARY OF THE INVENTION

The purpose of the invention is to create a rug binding machine that can be manufactured more simply and is more easily operated than the known machines.

This task is solved according to the invention by arranging the machine frame with motor, transportation mechanism, and looping mechanism as well as the holders as an integral compact unit which can be handled and guided along the outside of the edge of the material by means of at least one handle or hand grip, that the base member, bearing part or support means which engages the material and partially raises the material in the zone of the edge being bound is designed very low or flat to the floor and that only a single binding thread is guided in from the top.

The thus-devised manual rug binding machine can be present and conveniently used in every floor covering operation since it requires no large storage space. The carpet can be placed flat on the floor and the binding machine placed at the edge of the carpet from the outside and slid along it by hand. When this occurs, a bearing part or support means engages the material and curves it up somewhat without the need of folding the carpet back over its entire length.

As a result of the fact that the machine operates with only one thread, not only is it easier to change the binding thread including threading, but storage in small plants is also facilitated, since for every color, in the minimum case, only one roll of thread need be on supply.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

DETAILED DESCRIPTION OF THE PREFERRED EMBODIMENTS

Figure 1:
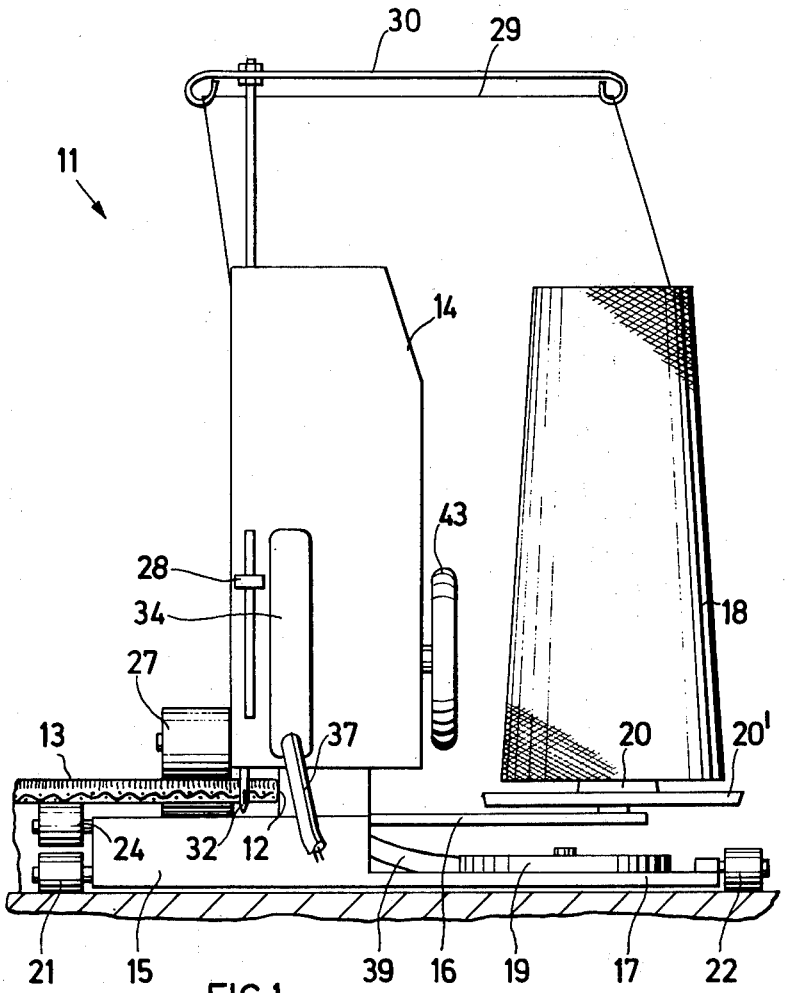
FIG. 1 shows a side elevation view of the rug binding machine according to the invention.

The rug binding machine 11 shown in the drawings is used to bind the edges 12 of a piece of material 13, e.g. carpeting, which is cut off from a roll. The machine 11 has a machine frame consisting of an upright column-like part 14, a lower base member, bearing part or support means 15 and holders 16 and 17 for the supply 18 of binding thread as well as a supply 19 of binding strip or tape. The binding thread supply consists of a very high and bulky spool of binding thread mounted on a spool core 20 which is seated on a plate 20' on the holder 16. The binding strip lies in the axial direction under the binding thread supply on the plate-shaped holder 17 which forms the lower edge of the machine together with the bottom side of the bearing part or support means 15. In the area of the lower edges of the machine, on the bearing part or support means 15 and holders 17, runners or roller 21 and 22 are provided, by means of which the machine may be moved along the floor. The runners may also be in the form of skids or the equivalent. The principal dimensions of the machine therefore lie in the vertical direction so that a very convenient machine results which may be used wherever carpet is to be laid.

Figure 2:
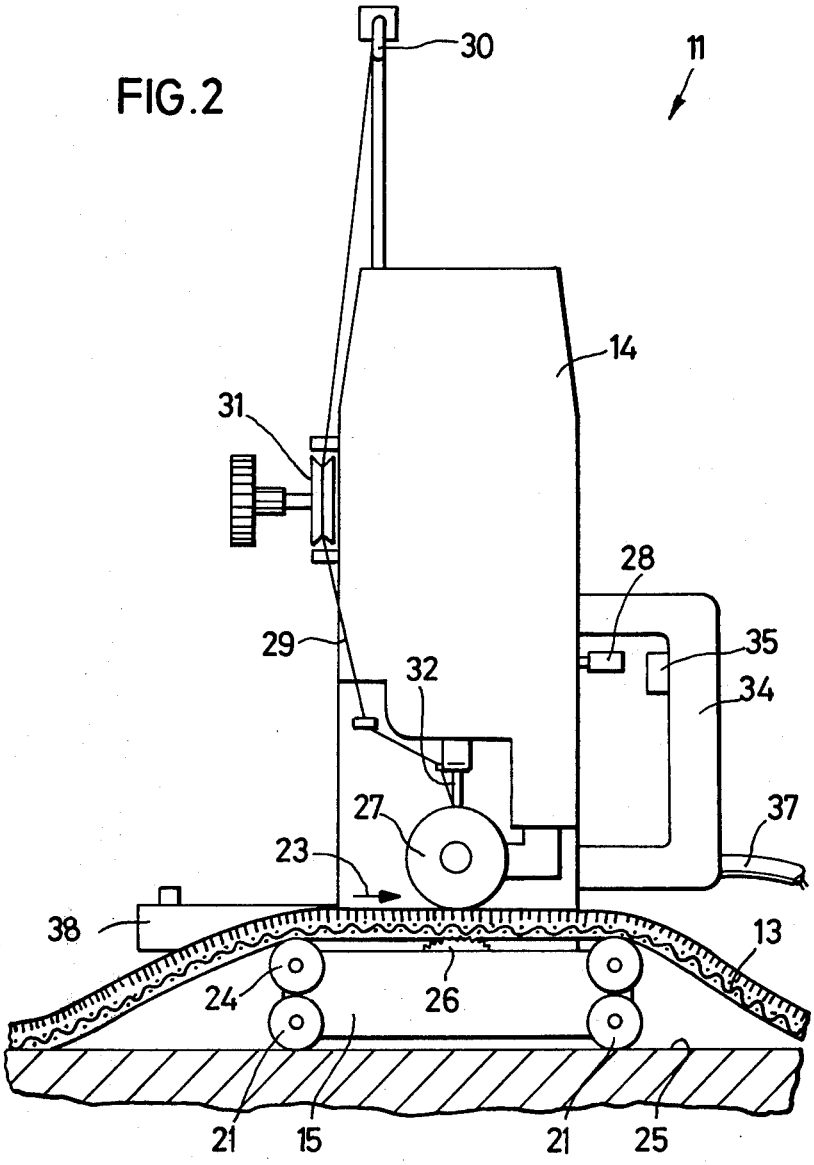
FIG. 2 shows a front elevation view seen from the working side.

Supporting table member 15 engages the underside of the material 13 providing support and has a relatively flat configuration. As FIG. 2 shows, the bearing or support member 15 is also very narrow in the direction of advance indicated by the arrow 23. Due to the runners or rolls 21 and 22 and the rolls 24 being mounted freely and extensibly on the upper side edges of the base member or support member 15, the material 13 can easily move over support means 15. FIG. 2 illustrates that the binding machine 11 can move along on the floor 25 during operation, while the carpet 13 to be bound, also lying on the floor, is arched up in the area or zone of support member or base plate 15 and settles down to the floor again after binding. Therefore, only the space of the carpet or rug itself is required for binding, i.e. the binding can take place in the space where the rug will later lie. FIG. 1 and FIG. 2 show that the material 13 is transported by a conveying or carrier mechanism means containing a roll 26 driven in steps, which is mounted in the bearing or support means 15 and which will be described in more detail below. Opposite roll 26 is an upper pressure roller 27, which is spring loaded in the downward direction and which presses the material 13 against the drive carrier roll 26, which is grooved for better conveying. The pressure roller 27 can be lifted manually by means of a lever 28. In the embodiment shown in FIGS. 1 and 2, the pressure roller is cylindrical.

The single binding thread 29 is supplied to the needle 32 of the binding mechanism 33, (FIG. 3) via a thread holder 30 and a conventional adjustable thread tightener 31 mounted on the column-shaped part 14.

A handle 34 is mounted on upright part 14 of the machine frame, containing a push-button switch 35 with which the motor 36 contained in part 14 can be set into operation. An electric or mechanical control means for control of the binding and conveying speed may be provided, the electrical connection cable 37 supplying current to the motor enters in the region of the handle.

The binding machine has a conventional strip inserting apparatus 38 which places a textile tape around the edge in a U-shape before binding in order to keep the fibers of the carpeting material from getting in between the individual binding threads. This binding tape 39 (FIG. 1) is completely covered by the binding yarn after binding. The details of the conventional tape inserting apparatus are not shown for reasons of simplifying the representation.

Figure 3:
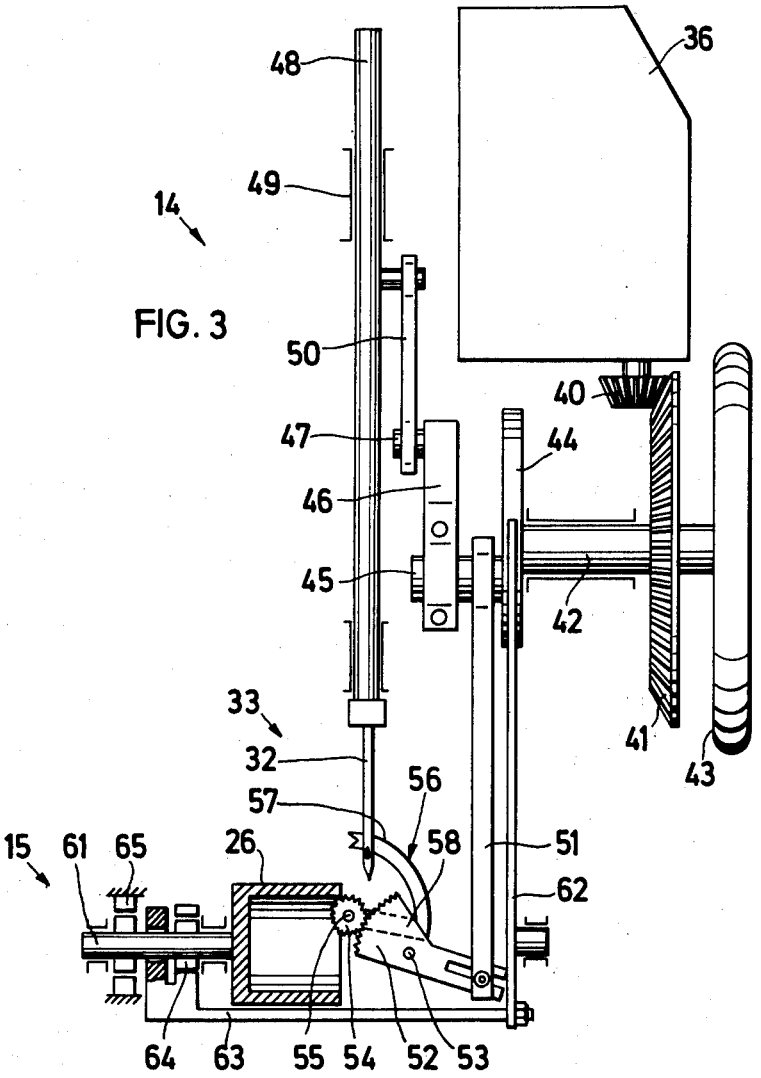
FIG. 3 shows a schematic representation of the sewing and transportation mechanism in side elevation view.

In FIG. 3, the mechanical structure of the binding and carrying mechanism is illustrated schematically. The electric geared drive motor 36 with a vertical axis is mounted inside the column-shaped part 14 of the binding machine. It acts via a bevel gear drive with a bevel pinion 40 and a bevel gear wheel 41 on a drive shaft 42 which is mounted essentially horizontally and carries a handwheel 43 on its rear free end. On its front end, i.e. left end in FIG. 3, it has a cam plate 44, a crank crankpin 45 and a crank 46 with a pin 47 which possesses significantly greater eccentricity than the crankpin 45 relative to the drive shaft 42. The crank 46 is adjustable on the crankpin 45 by means of clamping screws so that the relative position of the cranks with respect to each other is adjustable. A needle bar 48 is movably mounted, essentially vertically, in a needle guide 49. At its lower end, it carries a conventional needle 32 suited for relatively thick binding thread and can be moved up and down via a connecting rod 50 from the pin 47.

Figure 10:
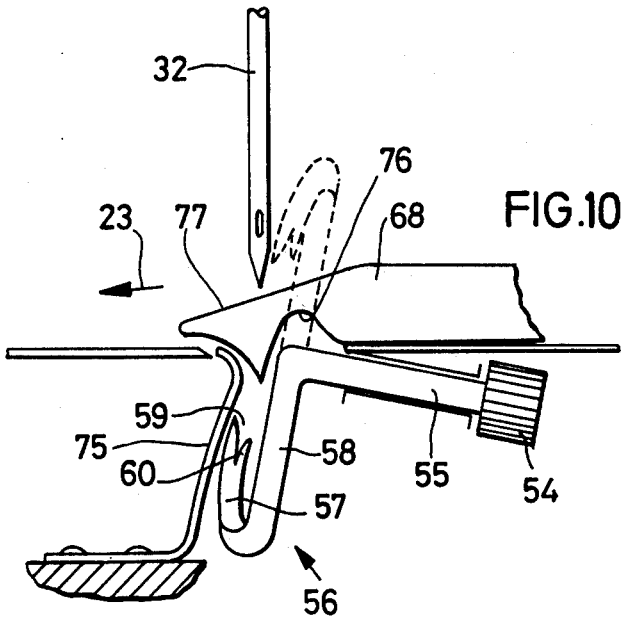
FIG. 10 shows a side view of the binding mechanism and particularly the looper, seen from the right in FIG. 3.

A connecting rod 51 on the crankpin 45 swivels a gear segment 52, which is capable of swiveling about an axle 53 that is essentially horizontal and points roughly in the direction of advance. The gear segment 52 engages gearwheel 54 mounted on a shaft 55. The latter is supported in bearing or support means 15 with a slight inclination with respect to the direction of advance in both the horizontal (see FIG. 10) lateral direction. A gripper 56 swivels together with gearwheel 54 and shaft 55. Gripper 56 comprises a gripper arm 57 curved approximately as an arc of a circle and connected to shaft 55 via an essentially radially directed swivel arm 58. FIG. 10 shows that the gripper arm 57 is somewhat laterally displaced with respect to the swivel arm 58 or it is curved so that it can grip around the needle 32.

Figures 5, 6, 7, 8, 9:
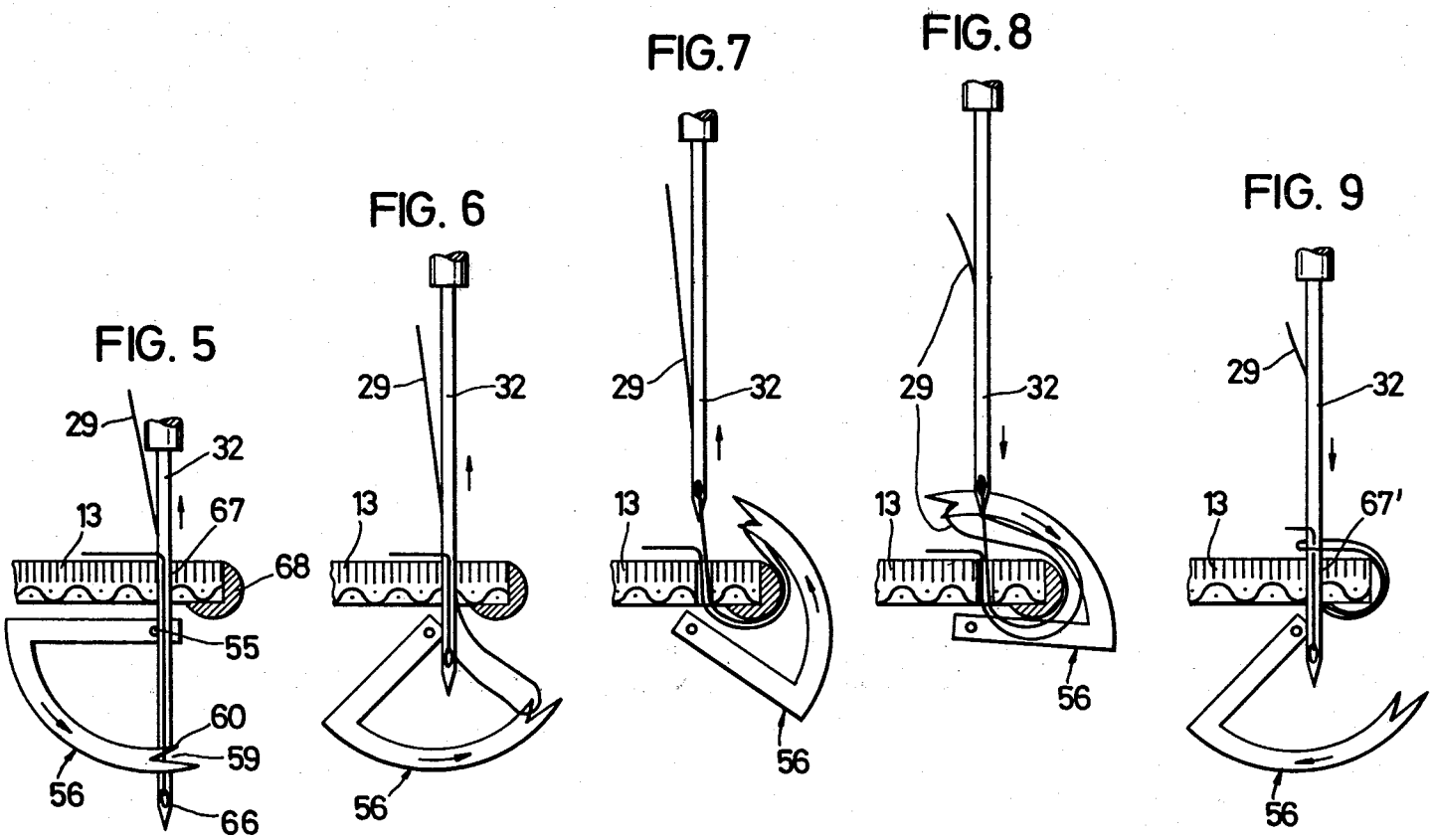
FIGS. 5–9 show schematic representations of the binding mechanism in different states of operation viewed in the binding direction.

The gripper arm 57 is designed in the shape of a fork 59 at its front end, having an inner shorter tine 60 and an outer longer tine. The inner tine 60, as shown in FIG. 5, passes in the lower position of the swivel arm 58 closer to needle 32 than the outer tine.

FIG. 10 also shows that the slope of the axle is selected such that the gripper 56 with its gripper arm 57 in the lower position runs behind needle 32 in the direction of advance 23 while the gripper arm in the upper position runs in front of needle 32 in the direction of advance, For the purpose of facilitating understanding, the direction of advance 23 here denotes the direction of entry of material 13 in the binding mechanism, while in reality the machine 11 moves against the direction of advance and the material 13 is normally stationary in the horizontal direction.

A guide 68 (see also FIGS. 5–8) guides both the edge 12 on the one side and the thread loop during the overedging on the side. The guide 68 is roughly conical in the direction of advance 23, and is supported by a leaf-spring 75 which introduces the threads individually and successively into the gap between itself and the bottom side of the guide, thus preventing the crossing of the threads. Besides a chamfer 77, the guide also has a cavity 76 for the gripper 56. Refer to FIG. 10 for the shape of the guide and leaf spring.

In FIG. 3, for the sake of simplicity, the pressure roller 27 is omitted from the carrier mechanism. The carrier roll 26 is hollow and designed in the shape of a can so that the gripper 56 is not impeded in its movement, which is described below. The roll 26 is mounted on one end of a shaft 61 which is rotatably mounted in the bearing part or support means 15. The outer ring of a clamping body lock mechanism 64 is actuated in steps via a lever 62 controlled by the cam disc 44 and a connecting rod 63, said locking mechanism taking the shaft 61 with it in one direction to execute a carrying step. A second clamping body locking mechanism 65 whose outer ring is fixed to its housing keeps the shaft 61 from rotating backward when the connecting rod 63 swivels in the opposite direction. The stroke of the lever 62 is adjustable by means of a limit screw, which is not shown, so that the step-wise rotation of the carrier roll 26 is infinitely adjustable.

Referring to FIGS. 5 to 9, the manner of functioning of the binding mechanism 33 is described below. FIG. 5 shows that after the needle 32 has pierced the material 13, the thread 29 guided through the eye 66 moves through the needle hole 67 formed by the needle twice, i.e. forth and back. FIG. 5 shows the mechanism shortly after the bottom dead center, i.e. the needle is already in its upward movement again and the gripper 56 has already moved in the swiveling direction which is counterclockwise as represented by the arrow. As a result of the upward movement of the needle, the thread no longer lies closely against the needle shaft but rather has formed a loop which is gripped by the gripper 56 with the inner tine 60 of the fork 59. The needle shaft is chamfered on the side where the fork passes it.

FIG. 6 now shows how the gripper 56 continues in its swivel movement in the counterclockwise direction as the needle 32 continues its upward movement and in so doing takes the loop of thread released by the needle with it. In FIG. 7, the gripper has already executed a turn through roughly 150° and the needle in its upward motion has already become free of the material 13. The thread loop carried by the fork 59 is folded around the edge 12 of the material 13. To prevent the thread from cutting into soft rug material, an angular but externally rounded guide 68 is installed in this region which covers the edge 12 but terminating in the binding direction shortly after the zone represented here as shown in the drawing so that the threads then enclose the edge 12 directly, i.e. with the binding tape between them, but which is not shown here for the sake of simplicity.

In the working position shown in FIG. 7, i.e. when the needle has left the hole 67, the carrier means is engaged and the rug material or entire machine 11 is moved forward a little by rotating the roll 26.

FIG. 8 shows the mechanism shortly after the top dead center, i.e. the needle 32 has already begun to move downward again while the gripper 56 is already beginning to turn back in the clockwise direction. As a result, the thread loop, which is still lying in the fork 59, has opened somewhat and the needle 32 is thrust into this thread loop. As the gripper 56 continues to turn or swivel in the clockwise direction, the loop emerges from the fork 59 and is drawn tight around the needle while the needle is now piercing the next or following hole in the material 13. The thread transferred by the needle from one hole to the next hole is now placed over one leg of the loop.

FIG. 9 shows the needle already in the next or following hole 67'. The gripper is still moving in the clockwise direction idly, while the needle pulls thread out of the supply via the thread tightener 31 as it moves downward in order to initiate a new operating cycle, which then begins again as shown in FIG. 5. Note that in the lower position shown in FIG. 5, the gripper 56 passes behind (but in the drawing in front of) the needle in the binding direction 23, while in FIG. 8, it passes in front of (but behind in the drawing) the needle 32 in the direction of advance 23. As a result, the needle can pierce across one leg of the thread loop.

Figure 4:
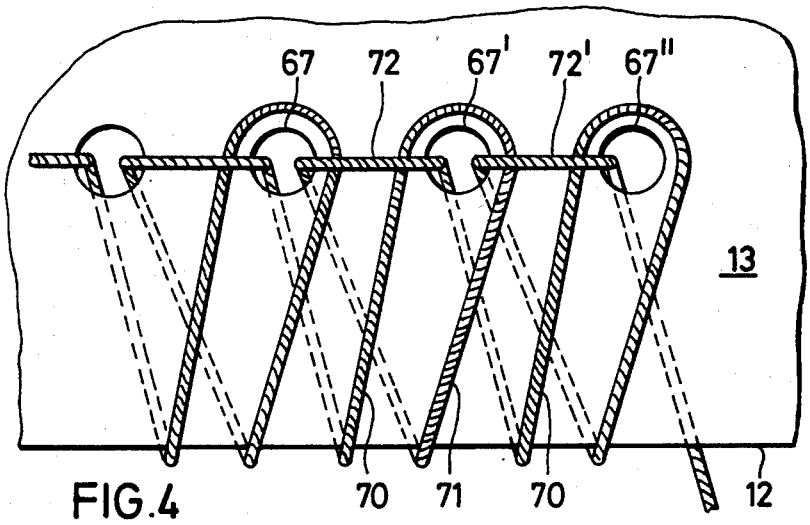
FIG. 4 is a schematic top view of a bound material edge in a simplified and extremely coarse manner of representation for purposes of clairty of illustration.

FIG. 4 shows the binding process. FIG. 4 is a top view of the top side so that the thread 29 on the top is shown by solid lines and on the bottom by broken lines. Two threads pass through every hole 67, 67' 67'', running essentially parallel to the edge 12 on the bottom and climbing up the latter. On the top, they form the legs 70, 71 of a thread loop which runs around the next following hole. Every two neighboring legs 70, 71 of neighboring loops are bridged by a thread segment 72 emerging from the previous hole (e.g. 67) and passing into the following hole (e.g. 67'). Therefore, a binding chain is formed containing two parallel-running binding threads on both sides for each hole, while, in addition, a relatively narrow chain is formed on the top from the thread segments 72 running essentially in the direction of the edge and the arch of the thread loop. As a result, a clear boundary is formed between the binding and the pile of the rug. It should also be noted that for better illustration, the binding in FIG. 4 is shown with exaggerated spacing, while in reality the binding threads lie very closely together. Thus, the threads in reality do not run nearly as obliquely as shown in the drawing.

The advantageous roller drive mechanism keeps the stitches from being so close together that the material, especially rug material with a back of foam plastic, is broken apart. The small number of needle holes is also advantageous, because two threads can pass through each hole.

Figure 11:
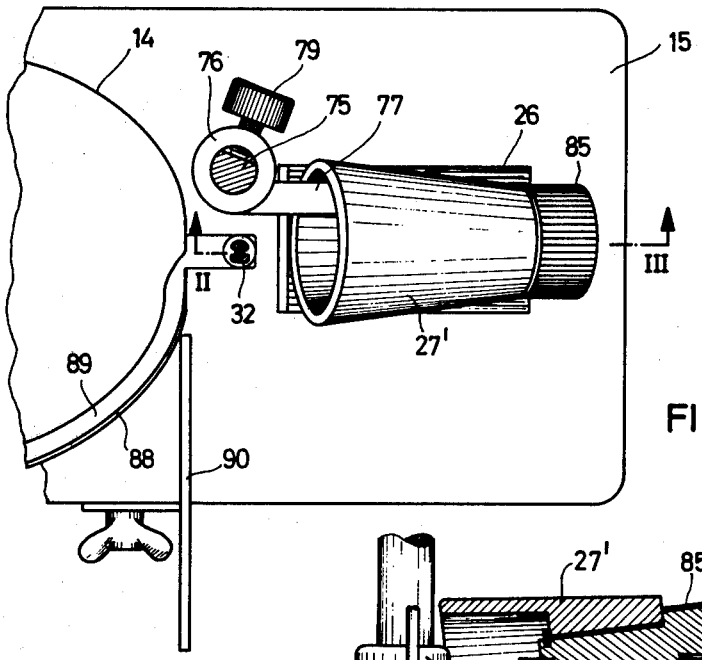
FIG. 11 is a top view of the carrier and pressure mechanism of another advantageous embodiment of a binding machine.
Figure 13:
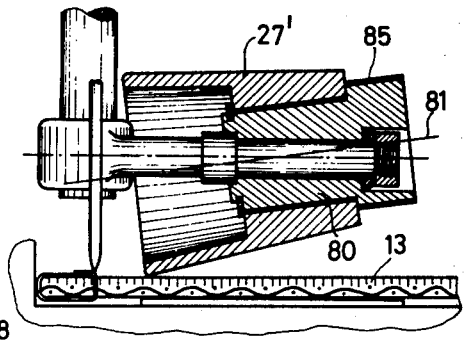
FIG. 13 is a cross-section view of the carrier mechanism corresponding to FIG. 12 in a work setting for binding curves.
Figure 12:
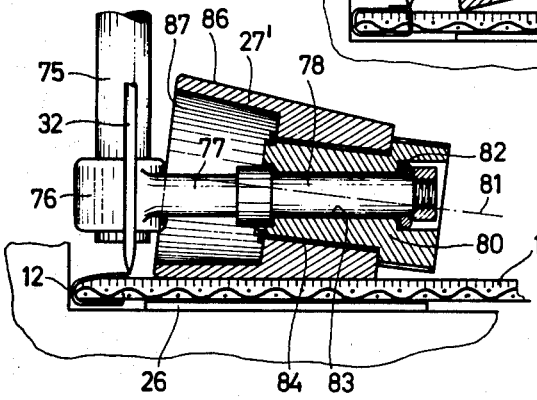
FIG. 12 is a partial cross-section view along line II–III of the carrier mechanism shown in FIG. 11 in its normal setting for binding straight edges.

In the following, the modification shown in FIGS. 11 through 13 is described. The same parts carry the same reference numbers.

On the upright part 14 of the machine, a vertical guide bar 75 is mounted, which is embraced by the eye 76 of a holder 77 carrying an adjusting axis 78 at its free end. The holder 77 is adjustable by means of a set screw 79 on the guide rod 75 and can be secured against turning, e.g. by a flattening on the guide rod which is engaged by the set screw. The adjusting axis or axle 78 penetrates a bearing box 80 on which a conical pressure roller 27'' is mounted so as to rotate about the turning axle or axis 81. Because the pressure roller can be swiveled away, the needle is easily accessible for threading and needle changing.

The adjusting axle is guided in a bore 83 of the bearing box 80 which goes through it obliquely, i.e. at an angle to the turning axle 81. The rotation of the bearing box about the adjusting axle is made difficult by means of a friction ring 82 held and kept under tension by a nut screwed onto the adjusting axle 78. Although manual adjustment is possible, spontaneous movement is impossible. The bearing box 80 has an adjusting area 85 which projects beyond the bearing face 84 and is knurled on its periphery so that it can be rotated as an adjusting knob.

The pressure roller 27' is mounted on the bearing face 84 and guided in the axial direction between the union bordering the adjustment area and a retaining ring. The increasing taper of the pressure roller 27 in the direction toward the needle is so great that, as FIG. 12 shows, the conical pressure area 86 of the pressure roller 27' runs parallel to the material 13 or the carrier roll 26 lying under the pressure roller. At its front side, facing the needle, the pressure roller has a larger diameter and is hollow so that the parts of the sewing mechanism, e.g. the gripper, are not impeded by it in any way. The holder 77 passes through the hollow space 87.

The part 14 forming the actual machine body is especially narrow at the level where the material is guided and equipped with thick roundings which deflect the edge 12 of the material away. In the intake zone (FIG. 1, bottom), an inner rounded edge guide 88 is provided which simultaneously defines a feed channel 89 for an ordinary binding tape. It is also equipped with a removable or swiveling straight guide 90 which partially overlaps the inner rounded edge guide 88.

In normal operation, the pressure roller 27' occupies a position such as shown in FIG. 12. In this case, the pressure face 86 lies on the material with linear contact so that the latter is gripped over a relatively large area and moved without leaving impressions. But now if one comes upon an outer or inner rounding, then the bearing box 80 is swiveled by rotation on the adjusting area 85 in such a way that the pressure face 86 in the zone facing away from the needle is lifted off the material surface and only the region of larger diameter of the conical pressure face lies on it. This region is relatively close to the needle. By appropriate choice of the chamfer of the bore 83 in the bearing box and the taper 86, this point can be moved even closer to the needle than shown in FIG. 13. The reduced pressure region makes it possible to turn the machine around small roundings without stitching too closely or too far apart.

As may be seen, the arrangement of the axes was selected such that with the pressure roller in the curve position shown in FIG. 13, the relative pressure of the pressure roller against the material is greater than in FIG. 12. This may be adjusted by turning the bearing box an appropriate distance by means of the adjusting knob 85.

In addition, during the binding of the inner edges, the inner rounded edge guide 88 becomes active by removing or folding back the straight guide 90. The machine can then be driven around relatively small inner roundings.

Numerous modifications of the embodiment shown and described are possible within the limits of the invention. Although the design with a bearing box capable of turning about a slanted axis is particularly simple, it is still possible to use a standard swivel mounting.

In view of the above, the present invention may be embodied in other specific forms without departing from the spirit or essential attributes thereof and, accordingly, reference should be made to the appended claims, rather than to the foregoing specification as indicating the scope of the invention.

I claim:

1. A binding machine for materials having an upper carpet surface and a lower basic surface such as carpets, carpet strips and the like, comprising:

a machine frame provided with a drive motor;

said motor driving a binding mechanism means including a substantially vertically guided straight needle;

said binding mechanism being mounted on a base member or support means for lifting the region of the material to be bound with the material being maintained during binding in a position with the upper carpet surface up;

said machine frame being provided with a holder for the supply of a single binding thread introduced via the straight needle from above;

means for carrying the material to be bound through the binding mechanism means;

said binding mechanism including a looping mechanism means for looping said single thread;

said machine frame with said motor, said carrier means and said binding mechanism means forming an integral, compact, portable unit operable by means of at least one hand grip to guide the binding machine along the outside edge of the material to be bound;

said support means for lifting the region of the edge of the material being bound being of a relatively low or flat to the floor configuration relative to the configuration of the machine frame, and being short in the direction in which the material is carried through the machine;

said carrying means having roller means mounted on the edges of an upper portion of said support means for guiding the lower basic surface of the material to be bound which is partially arched up to the upper surface of said support means from the flat to the floor position during binding; and, runners mounted to the lower portion of said support means for enabling movement of said machine on a floor.

2. A binding machine in accordance with claim 1 which performs a binding operation with only one thread.

3. A binding machine in accordance with claim 1 including an inner rounding edge guide which displays a curvature pointing away from the edge of the material to be bound.

4. A binding machine in accordance with claim 3 wherein said inner rounding edge guide forms part of the guide for a binding strip.

5. A binding machine in accordance with claim 3 wherein a removable straight guide is provided which normally covers the inner rounding edge guide, at least partially.

6. A binding machine for materials such as carpets, carpet strips and the like, comprising:

a machine frame provided with a drive motor; p1 said motor driving a binding mechanism means including a substantially vertically guided straight needle;

said binding mechanism being mounted on a base member or support means for lifting the region of the material to be bound;

said machine frame being provided with a first holder for the supply of a single binding thread introduced via the straight needle from above;

means for carrying the material to be bound through the binding mechanism means;

said binding mechanism including a looping mechanism means for looping said thread;

said machine frame with said motor, said carrier means and said binding mechanism means forming an integral, compact, portable unit operable by means of at least one hand grip to guide the binding machine along the outside edge of the material to be bound;

said support means for lifting the region of the edge of the material being bound being of a relatively low or flat to the floor configuration relative to the configuration of the machine frame;

a transmission for driving said binding mechanism;

a needle rod for carrying said needle;

a needle guide for said needle rod;

said motor, said transmission, said needle guide and said needle rod installed together in a column-shaped portion of the machine frame having greater height than basis dimensions and standing erect in the direction of said needle axis said support means having a length that is less than the height of the column shaped portion.

said support means being attached on the bottom of said column-shaped portion of the machine frame, pointing into a first direction;

said first holder for the supply of binding thread being mounted on the side of said column-shaped portion, and projecting from the bottom part of said column-shaped portion into a direction opposed to said first direction;

said first holder holding said supply of binding thread parallel to and beside said column-shaped portion; and, a second holder for binding strip being arranged beneath said first holder for said binding thread.

7. A binding machine in accordance with claim 6 wherein said motor drives a horizontal transmission shaft by means of a bevel gear drive, said horizontal transmission shaft being provided with means for driving said binding mechanism means and said carrier means.

8. A binding machine in accordance with claim 6, which performs a binding operation with only one thread.

9. A binding machine in accordance with claim 6, including an inner rounding edge guide which displays a curvature pointing away from the edge of the material to be bound.

10. A binding machine in accordance with claim 9, wherein said inner rounding edge guide forms a part of the guide for a binding strip.

11. A binding machine in accordance with claim 9, wherein a removable straight guide is provided which normally covers the inner rounding edge guide, at least partially.

12. A binding machine for materials such as carpets, carpet strips and the like, comprising:

a machine frame provided with a drive motor;

said motor driving a binding mechanism means including a substantially vertically guided straight needle;

said binding mechanism being mounted on a base member or support means for lifting the region of the material to be bound;

said machine frame being provided with a holder for the supply of a single binding thread introduced via the straight needle from above;

means for carrying the material to be bound through the binding mechanism means;

said binding mechanism including a looping mechanism means for looping said single thread;

said binding mechanism including a gripper means for grasping a thread loop formed by said needle after said needle passes through the material, said gripper moving said loop around a guide means extending along and covering the edge of the material to be bound and placing said loop on the other side of the material in such a position that said needle pierces the loop during the next pass through the material;

said gripper means mounted so as to swivel on a shaft slanted with respect to the binding direction, whereby said gripper means, viewed in the direction of motion of the material relative to the machine, is located behind said needle when gripping the thread loop and passes in front of said needle on the other side of said material; and said guide means ending closely behind the needle's position when viewed in said direction of motion.

13. A binding machine in accordance with claim 12 which produces a binding having on one side two thread segments emerging from a first needle hole (67), said thread segments running toward the edge and around the edge to the other side where one of said thread segments forms a current loop about a following second needle hole, one of the thread segments (72) coming from the first needle hole (67) and running on said other side through one leg of the current loop and a leg (70) of the previous loop holds said thread segments down while the other leg (71) of the current loop as well as a leg (70) of the next loop is gripped and held by the other of said thread segments (72') running on said other side from said second needle hole (67') to a third needle hole (67'').

14. A binding machine in accordance with claim 12 wherein said gripper means has a gripper arm in the form of a segment of an arch which is mounted to turn on a swivel arm through more than 180°.

15. A binding machine in accordance with claim 12 wherein said gripper means is provided with a two-tined fork.

16. A binding machine in accordance with claim 12 wherein said gripper means is contained in said bearing or support means and is operated by a gear wheel and a gear segment operated via an eccentrically mounted connecting rod.

17. A binding machine in accordance with claim 12 wherein said gripper means enters a hollow carrier roll during its turning path.

18. A binding machine in accordance with claim 12, wherein said guide means for the edge of the material to be bound include a coordinating leaf spring between said material and said binding thread.

19. A binding machine for materials such as carpets, carpet strips and the like, comprising:

a machine frame provided with a drive motor;

said motor driving a binding mechanism means including a substantially vertically guided straight needle;

said binding mechanism being mounted on a base member or support means for lifting the region of the material to be bound;

said machine frame being provided with a holder for the supply of a single binding thread introduced via the straight needle from above;

means for carrying the material to be bound through the binding mechanism means;

said binding mechanism including a looping mechanism means for looping said single thread;

said machine frame with said motor, said carrier means and said binding mechanism means forming an integral, compact, portable unit operable by means of at least one hand grip to guide the binding machine along the outside edge of the material to be bound;

said support means for lifting the region of the edge of the material being bound being of relatively low or flat to the floor configuration relative to the configuration of the machine frame;

said carrier means including a roll driven in steps with an infinitely variable step length; and said carrier means provided with a pressure roller having a pressure area near to the needle.

20. A binding machine in accordance with claim 19 wherein said roll drive includes free-wheeling-like locking members.

21. A binding machine in accordance with claim 19 wherein said pressure roller which normally lies against the material along a longitudinal line is adjustable so as to lie against an outer edge.

22. A binding machine in accordance with claim 21 wherein the axis of rotation of said pressure roller may be swivelled.

23. A binding machine in accordance with claim 22 wherein said axis of rotation of said pressure roller may be rotated about an adjusting axis which runs at an angle to the axis of rotation.

24. A binding machine in accordance with claim 19 wherein said pressure roller is of a conical shape.

25. A binding machine in accordance with claim 24 wherein the angle of taper of said pressure roller is equal to the angle by which the adjusting axis deviates from the axis of rotation.

26. A binding machine in accordance with claim 25 including a bearing box for holding the pressure roller which is provided with a bore running at the above named angle to the axis of rotation and into which the adjusting axis extends.

27. A binding machine in accordance with claim 19 wherein said pressure roller is a non-driven counter-pressure roll which works jointly with a driven carrier roll.

28. A binding machine in accordance with claim 19 wherein the pressure of said pressure roller is intensified by the adjustment to a reduced pressure area on the material.

29. A binding machine in accordance with claim 19 wherein said pressure roller is hollow in the direction facing the needle.

30. A binding machine in accordance with claim 19 wherein said pressure roller may be manually lifted off and swivelled away.

31. The binding machine in accordance with claim 19, wherein said pressure roller may be adjusted to alter the pressure area on the material.

32. A binding machine in accordance with claim 31, wherein said pressure roller may be adjusted such that the pressure area may be displaced toward the needle.

* * * * *